US006450714B2

(12) United States Patent
Mori et al.

(10) Patent No.: US 6,450,714 B2
(45) Date of Patent: Sep. 17, 2002

(54) THERMAL PRINTER WITH A MOVABLE PLATEN GUIDED BY A PIN

(75) Inventors: Yukihiro Mori, Iiyama; Sumio Watanabe, Hoofddorp; Fumio Sakurai, Tokyo, all of (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/756,794

(22) Filed: Jan. 10, 2001

Related U.S. Application Data

(63) Continuation of application No. 09/300,431, filed on Apr. 28, 1999, now Pat. No. 6,336,760.

(30) Foreign Application Priority Data

Sep. 25, 1998 (JP) ..... 10-271081

(51) Int. Cl.[7] ..... B41J 11/14; B41J 25/304

(52) U.S. Cl. ..... 400/649; 400/120.16; 347/220

(58) Field of Search ..... 400/120.01, 120.16, 400/120.17, 653, 649; 347/197, 198, 220

(56) References Cited

U.S. PATENT DOCUMENTS

| | | | | |
|---|---|---|---|---|
| 4,592,670 A | * | 6/1986 | Frank et al. | 400/637.6 |
| 4,663,638 A | | 5/1987 | Hirose | |
| 4,909,645 A | | 3/1990 | Sudo et al. | |
| 5,183,347 A | | 2/1993 | Higuchi et al. | |
| 5,198,836 A | | 3/1993 | Saito et al. | |
| 5,228,793 A | * | 7/1993 | Ferrie | 400/692 |
| 5,296,874 A | | 3/1994 | Nagata et al. | |
| 5,548,318 A | | 8/1996 | Ro et al. | |
| 5,594,487 A | | 1/1997 | Nuita et al. | |
| 5,625,400 A | | 4/1997 | Kubo | |
| 5,725,317 A | | 3/1998 | Gonmori et al. | |
| 5,782,567 A | | 7/1998 | Endo | |

FOREIGN PATENT DOCUMENTS

| | | | | |
|---|---|---|---|---|
| EP | 0 372 753 A2 | | 6/1990 | |
| JP | 61-290072 | | 12/1986 | |
| JP | 3-207681 A | * | 9/1991 | 347/220 |
| JP | 4-148749 A | * | 5/1992 | 271/273 |
| JP | 5-220989 A | * | 8/1993 | 347/197 |
| JP | 7-132653 | | 5/1995 | |
| JP | 10-114091 | | 5/1998 | |
| JP | 10-147023 | | 6/1998 | |

OTHER PUBLICATIONS

Communication, European Search Report issued in European Patent Office on Mar. 30, 2001.
Cummunication including European Search Report issued in European Patent Office on Aug. 31, 2000.

* cited by examiner

*Primary Examiner*—Daniel J. Colilla
(74) *Attorney, Agent, or Firm*—Staas & Halsey LLP

(57) ABSTRACT

A thermal printer is provided. The thermal printer includes a thermal head module, a platen module, and a gear module. The platen module and the gear module are connected to the thermal head module. When setting a recording sheet to the printer, the operator lifts up a knob provided to the platen module, so that the platen module is rotated counterclockwise around a pin provided to the thermal head module. In this manner, the platen separates from the thermal head, and setting a recording sheet becomes easier.

12 Claims, 16 Drawing Sheets

THERMAL PRINTER WITH A MOVABLE PLATEN GUIDED BY A PIN

CROSS REFERENCE TO RELATED APPLICATIONS

This application is a continuation of application Ser. No. 09/300,431, filed Apr. 28, 1999, now U.S. Pat. No. 6,336,760.

BACKGROUND OF THE INVENTION

1. Field of the Invention

The present invention generally relates to a thermal printer, and more specifically, to a thermal printer attached to a POS (Point Of Sales) device.

A thermal printer used in a POS device should be small in size and easy to set a recording sheet. This also applies to a thermal printer incorporated into a portable device.

2. Description of the Related Art

FIG. 1 illustrates an example of a conventional thermal printer. The thermal printer 10 comprises a thermal head 11 and a platen 12. The thermal printer 10 is incorporated into a sheet holder 13. The thermal head 11 is separated from the platen 12 by a cam mechanism so as to form a space between the thermal head 11 and the platen 12. A recording sheet 15 pulled out from a roll 14 is set between the thermal head 11 and the platen 12.

FIG. 2 illustrates another example of a conventional thermal printer. The thermal printer 20 is formed integrally with a sheet holder device 21. The sheet holder device 21 comprises a lower box-like member 22 and an open-close upper cover 23. The upper cover 23 is opened to set a roll 26 into the sheet holder device 21. The thermal printer 20 comprises a thermal head 24 fixed onto the inner surface of the lower box-like member 22 and a platen 25 attached to the edge of the upper cover 23. When the upper cover 23 is closed, the platen 25 is in contact with the thermal head 24. When the upper cover 23 is opened, the platen 25 is separated from the thermal head 24.

To set a recording sheet, the upper cover 23 is opened, the roll 26 is set, a recording sheet 27 pulled out from the roll 26 is pulled over the front side of the thermal head 24, and the upper cover 23 is then closed.

In the thermal printer 10 of FIG. 1, the thermal head 11 is separated from the platen 12. Due to a head pressing plate spring provided to the thermal head 11, the thermal head 11 can move only a limited distance. As a result, it is difficult to form a side sheet passage between the thermal head 11 and the platen 12. Accordingly, setting a recording sheet 15 between the thermal head 11 and the platen 12 is difficult.

Furthermore, moving the thermal head 11 might result in a deviation of the position of the thermal head 11 when it is returned. Such a positional deviation of the thermal head 11 might cause uneven printing.

To avoid deformation of the rubber platen 12, the thermal head 11 is kept separate from the platen 12 at the time of shipment of the thermal printer 10. However, moving the thermal head 11 adds to the force of the head pressing plate spring. If such a condition is maintained for a long period of time, the increased spring force deforms the main body of the thermal printer 10.

In the thermal printer 20 of FIG. 2, when the upper cover 23 is opened, the platen 25 moves. A side space is formed between the platen 25 and the thermal head 24, so that a recording sheet 27 is easy to set to this printer. However, when the platen 25 is brought back into contact with the thermal head 24, the platen 25 is substantially moved in the direction of the surface of the thermal head 24. Even a small fluctuation positioning causes a positional fluctuation of the platen 25 with respect to the heat generating member 24*a* in the thermal head 24. As s result, uneven printing is often carried out.

Furthermore, since the thermal printer 20 is integrally formed with the sheet holder device 21, it includes an extra portion for setting the roll 26. As a result, the thermal printer 20 is large in size.

SUMMARY OF THE INVENTION

The principal object of the present invention is to provide a thermal printer which is free of the above problems.

The object of the present invention is achieved by a thermal printer comprising a thermal head and a platen as a unit. The platen is detachable from the thermal head. The platen is moved from the thermal head so as to form a sheet passage for setting a recording sheet between the thermal head and the platen.

The thermal head is provided with a head pressing plate spring on its rear side, and movements of the thermal head are limited. On the other hand, the platen is not limited in movement. Compared with the thermal head, the platen can be moved a greater distance. Accordingly, a wider sheet passage can be formed by moving the platen instead of moving the thermal head. Thus, feeding a recording sheet into the sheet passage can be easier.

In the thermal printer of this invention, the direction of the platen separating from the thermal head is perpendicular to the surface of the thermal head.

The platen is vertically brought back into contact with the surface of the thermal head. The position of the returned platen might fluctuate with respect to the thermal printer, but the positional relationship between the platen and the thermal head is accurately maintained. Thus, uneven printing can be prevented even after the recording sheet setting is repeated many times.

The object of the present invention is also achieved by a thermal printer which comprises a main body, a thermal head attached to the main body, and platen. The thermal printer and the platen form a unit. The platen is attached to a sheet guide member for guiding a recording sheet between the platen and the thermal head. A sheet roll for holding a recording sheet is also included. A sheet guide member for guiding a recording sheet pulled out from a sheet roll into a space between the platen and the thermal head. The sheet guide member is attached to the main body. By separating the sheet guide member from the thermal head, a sheet passage for transporting a recording sheet between the thermal head and the platen is formed.

In this structure, the inlet path leading to the sheet passage is wider, and setting a recording sheet into the sheet passage is easier.

The object of the present invention is also achieved by a thermal printer which comprises a thermal head attached to a main body and a platen provided with bearings on both ends. The thermal head and the platen form a unit. The bearings of the platen are engaged with flanges on both sides of a sheet guide member for introducing a recording sheet pulled out from a sheet roller into a space between the platen and the thermal head. The platen and the sheet guide member form a platen module. The main body has bearing portions each provided with an opening. The platen module is attached to the main body, with the bearings being engaged with the bearing portions of the main body. By lifting up the sheet guide member of the platen module, the bearings are first rotated in the bearing portions, and the bearings then come out from the bearing portions through the openings. The platen is thus separated from the thermal head, thereby forming a sheet passage for setting a recording sheet between the thermal head and the platen.

By the simple action of lifting up the sheet guide member of the platen module, the platen can be separated from the thermal head.

When the platen is in contact with the thermal head, the bearings and the bearing portions vertically receive the force of the thermal head pressing the platen.

The bearing portions firmly hold the bearings, so that the platen can be fixed without runout.

When the platen is in contact with the thermal head, the bearings are subjected to a rotating force in a direction opposite to the direction of the bearings coming out from the bearing portions through the openings.

By subjecting the bearings to the rotation force in the direction opposite to the direction of the bearings coming out from the bearing portions, the bearings are firmly secured in the bearing portions.

The platen module has a mechanism for click-locking the platen module to the main body when the sheet guide member is lifted up.

In this structure, a recording sheet can be set by both hands, with the platen module being maintained in the lifted position.

The platen module also has a mechanism for click-locking the platen module to the main body when the sheet guide member is pushed back to its original position.

With this mechanism, the operator can surely recognize when the sheet setting is complete.

The object of the present invention is also achieved by a thermal printer which comprises a thermal head attached to a main body having grooves extending in a direction perpendicular to the surface to the thermal head, and a platen whose shaft is engaged with the grooves of the main body. The thermal head and the platen form a unit. The platen is guided along the grooves of the main body, so that the platen can be separated from and brought back into contact with the thermal head.

When the sheet setting is complete and the platen is brought back to the original position, the platen vertically approaches the surface of the thermal head. Even if the position of the returned platen fluctuates, the contact position on the thermal head is precisely maintained. Thus, uneven printing can be prevented.

The thermal head is engaged with the grooves and positioned by them. This adds to the positioning accuracy between the thermal head and the platen when. the platen is brought back into contact with the thermal head. Thus, uneven printing can be avoided.

The object of the present invention is also achieved by a thermal printer which comprises a thermal head module and a platen module. In the thermal head module, a thermal head and a motor are attached to a main body. The platen module includes a platen and a sheet guide member for guiding a recording sheet pulled out from a sheet roll into a space between the platen and the thermal head. The sheet guide member of the platen module is attached to the main body of the thermal head module.

The above thermal printer further comprises a gear module which reduces the rotation speed of the motor and then transmits the reduced rotation to the platen. The gear module is attached to a side surface of the thermal head module.

The thermal printer further comprises an auto-cutter module attached onto the upper surface of the thermal head module.

The thermal printer further comprises a journal takeup module for taking up a journal sheet. The journal takeup module is arranged next to the auto-cutter module on the upper surface of the thermal head module.

Having the components as modules, designing the printer is easier than designing a conventional printer.

The above and other objects and features of the present invention will become more apparent from the following description taken in conjunction with the accompanying drawings.

DESCRIPTION OF THE PREFERRED EMBODIMENTS

Figure 1:
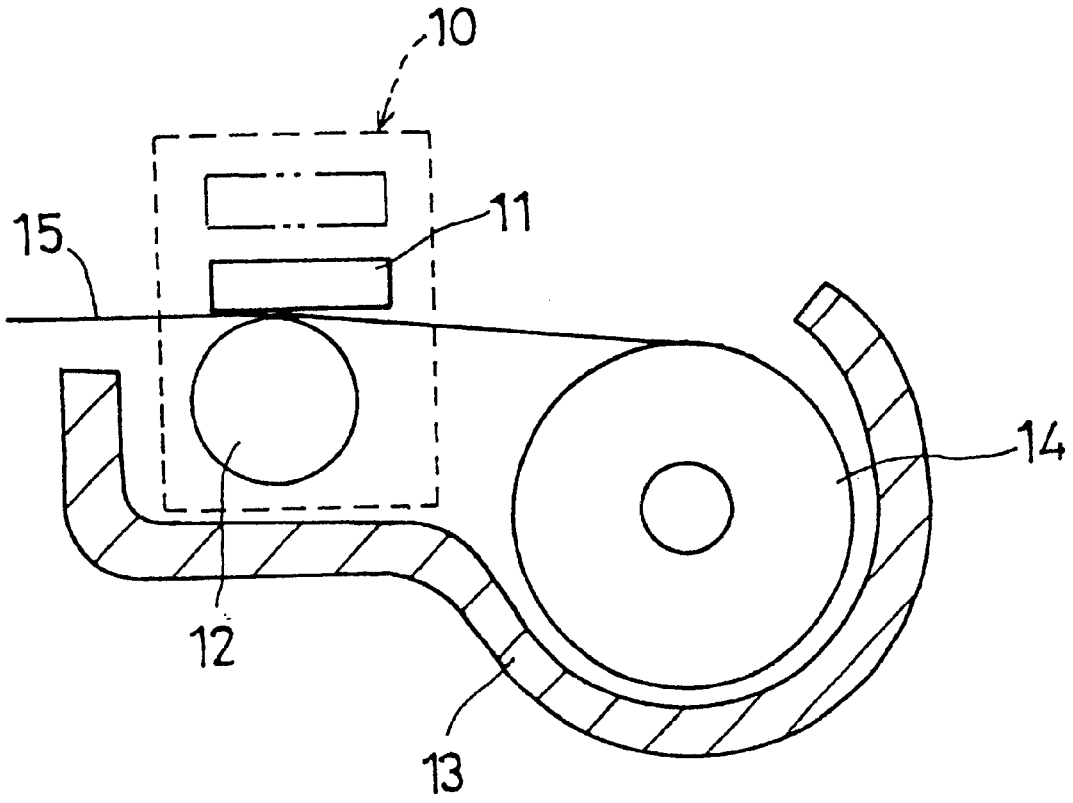
FIG.1 (PRIOR ART)
FIG. 1 is a schematic view of an example of the conventional thermal printer.
Figure 2:
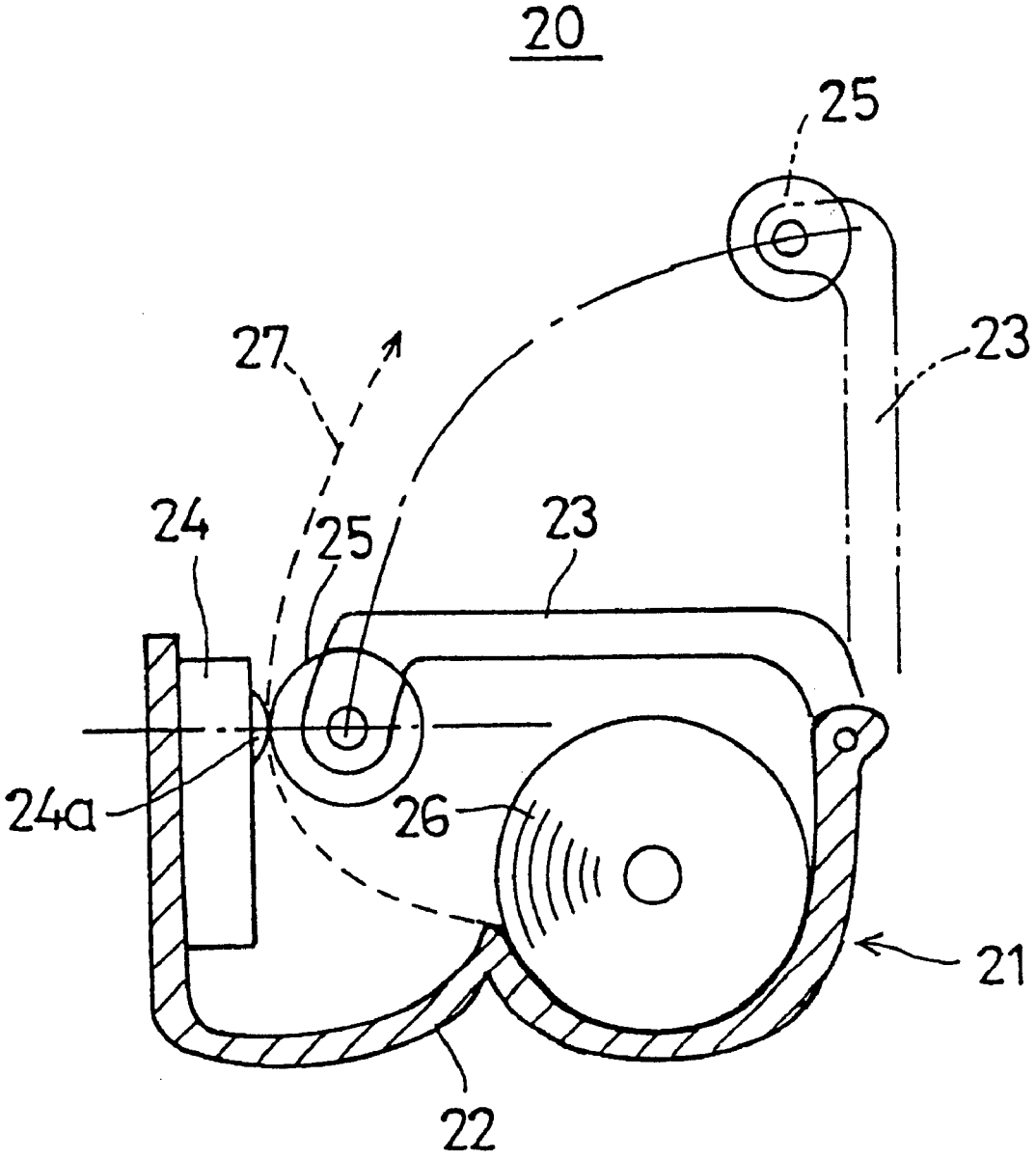
FIG.2 (PRIOR ART)
FIG. 2 is a schematic view of another example of the conventional thermal printer.
Figure 3:
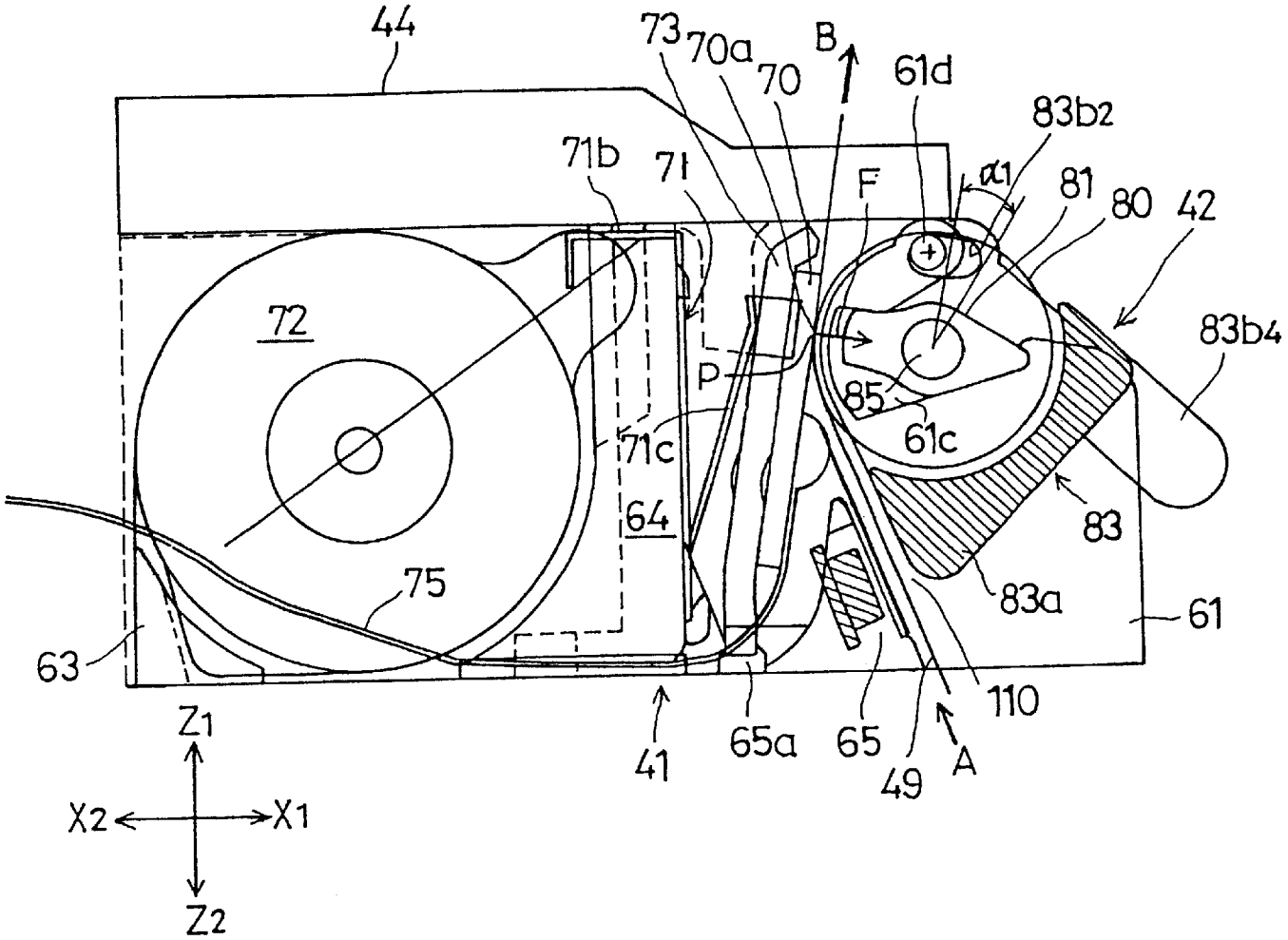
FIG. 3 is a side view of a first embodiment of the thermal printer of the present invention.
Figure 4:
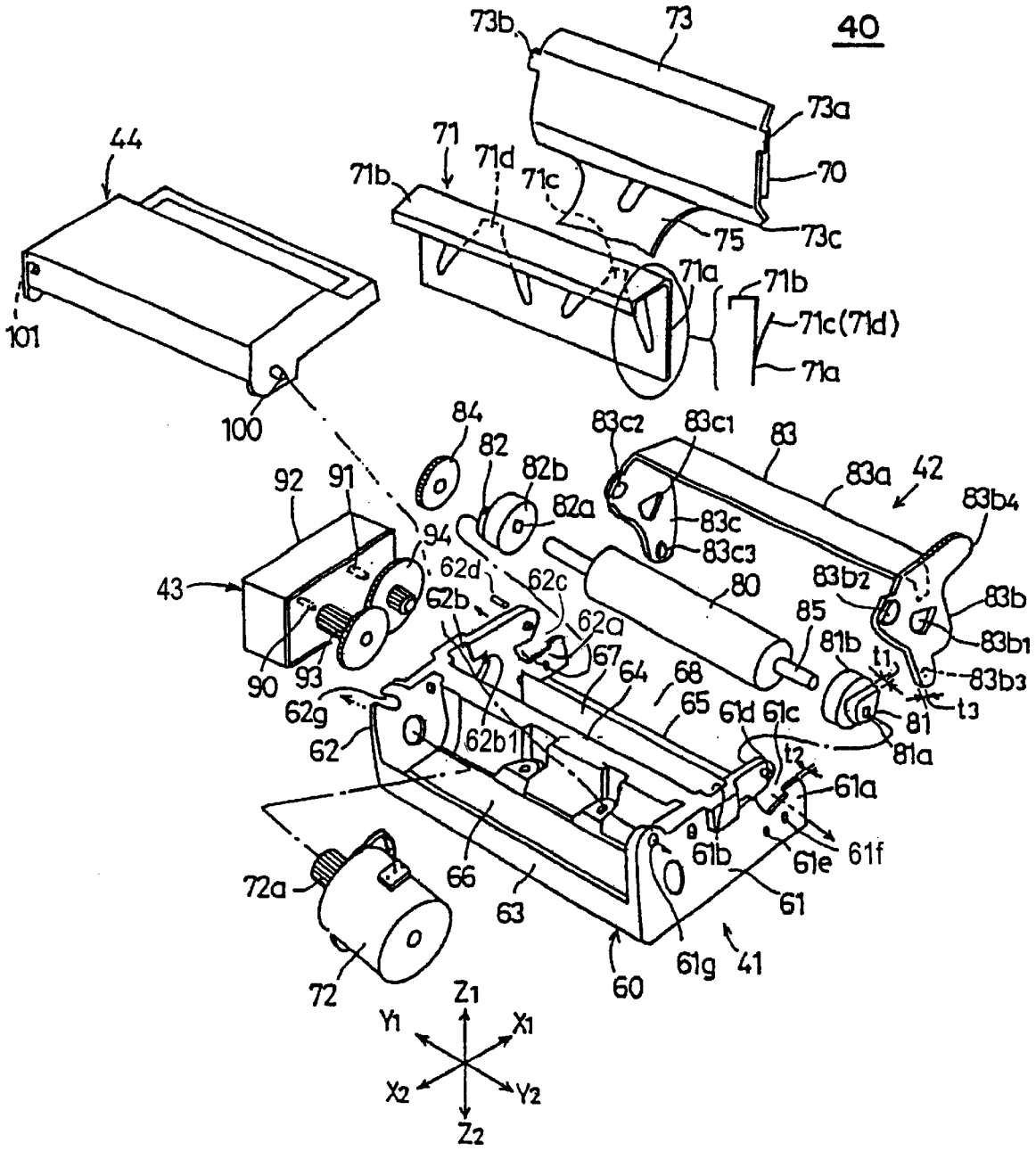
FIG. 4 is an exploded perspective view of the thermal printer of FIG. 3.
Figure 5:
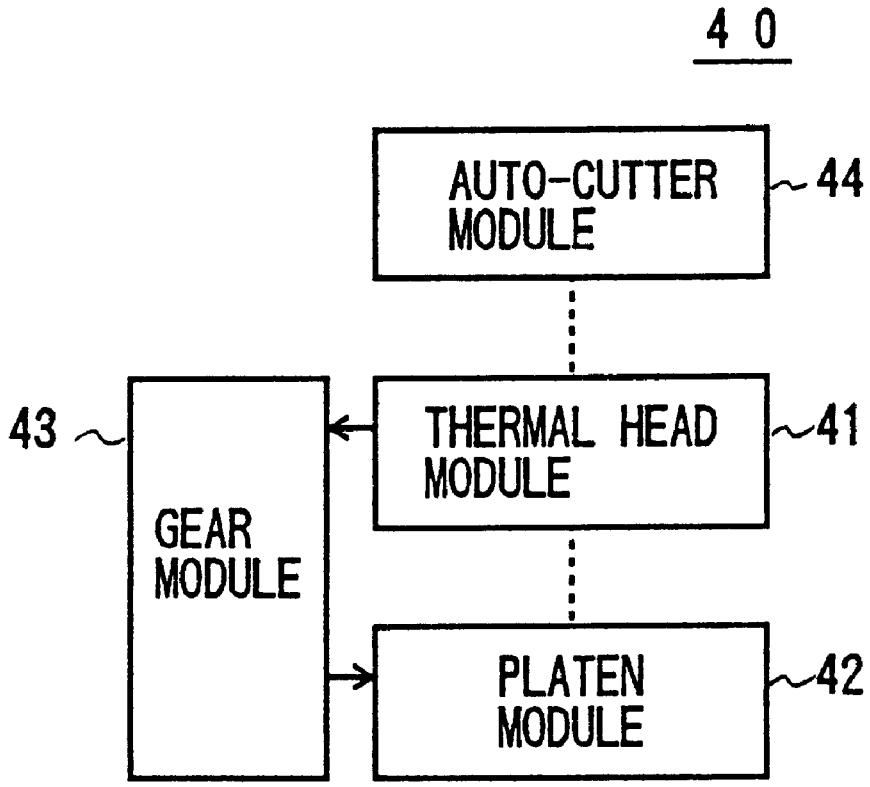
FIG. 5 is a diagram of the structure of the thermal printer of FIGS. 3 and 4.
Figure 6:
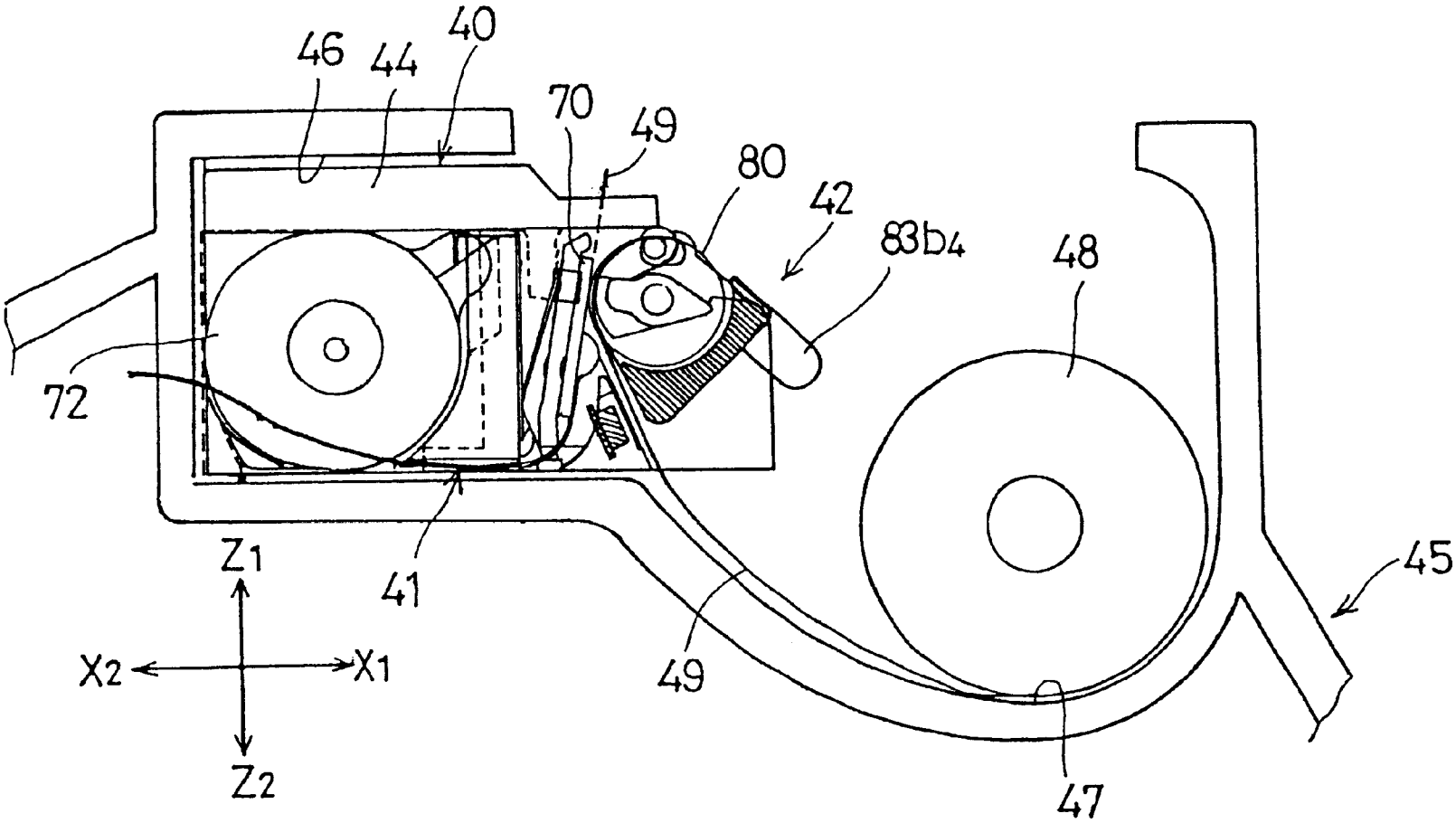
FIG. 6 illustrates the thermal printer of FIG. 3 incorporated into a POS device.

FIGS. 3 and 4 illustrate a thermal printer 40 of a first embodiment of the present invention. The thermal printer 40 comprises a thermal head module 41, a platen module 42, a gear module 43, and an auto-cutter module 44, with the thermal head module 41 being in the center, as shown in FIG. 5. The platen module 42, the gear module 43 and the auto-cutter module 44 are connected to the thermal head module 41, thereby forming a small-size unit. When a recording sheet is set, the platen moves to open and close the unit, which has a size to fit a thermal printer incorporating space 46. As shown in FIG. 6, the thermal printer incorporating space 46 and a roll-set portion 47 are adjacent to each other and formed on the upper part of a POS device 45. The thermal printer 40 is incorporated into the thermal printer incorporating space 46. A recording sheet 49 rolled out from a roll 48 contained in the roll-set portion 47 is sandwiched by a thermal head 70 and a platen 80, and passes through the auto-cutter module 44 in the thermal printer 40.

Each "modules" in the thermal printer 40 is an assembled member consisting of a plurality of parts. In the drawings, "X1" and "X2" indicate the longitudinal direction of the thermal printer 40; "Y1" and "Y2" indicate the crosswise direction of the thermal printer 40; and "Z1" and "Z2" indicate the thickness direction of the thermal printer 40. The side of the X1 direction is the front side of the thermal printer 40, and the side of the X2 direction is the rear side of the thermal printer 40.

1) Thermal head module 41

The thermal head module 41 is the module that forms the center of the thermal printer 40. The thermal head module 41 comprises a rectangular main body 60, the thermal head 70 attached to the main body 60, a head pressing plate spring 71, and a pulse motor 72.

The main body 60 is a synthetic resin molding or an aluminum die casting. The main body 60 comprises two side plates 61 and 62 in the Y1–Y2 directions, and three beams 63, 64, and 65 extending in the Y1–Y2 directions between the side plates 61 and 62. The beam 64 is situated in the center of the X1–X2 line, the beam 63 is situated at the end of the X2 direction, and the beam 65 is situated closer to the end of the X1 direction than the beam 64. A pulse motor accommodating portion 66 is formed between the beams 63 and 64. A thermal head accommodating portion 67 is formed between the beam 64 and the beam 65. The beam 64 is used for attaching the head pressing plate spring 71. A platen module accommodating portion 68 is formed between protrusions 61*a* and 62*a* protruding from the beam 65 in the X1 direction The main body 60 is symmetrical with respect to an X-Z plane that goes through the center of the Y1–Y2 line. The side plate 62 has portions equivalent to those formed on the side plate 61, though they are not shown in the figures.

In the thermal head accommodating portion 67, L-shaped grooves 61*b* and 62*b* for positioning the thermal head 70 are formed on the inner surfaces of the side plates 61 and 62. The beam 65 is provided with a thermal head receiving portion 65*a*.

In the platen module accommodating portion 68, the side plates 61 and 62 are both provided with Ω-shaped bearing portions 61*c* and 62*c*, a pin 61*d*, and click-lock concave portions 61*e* and 61*f*.

Figure 7:
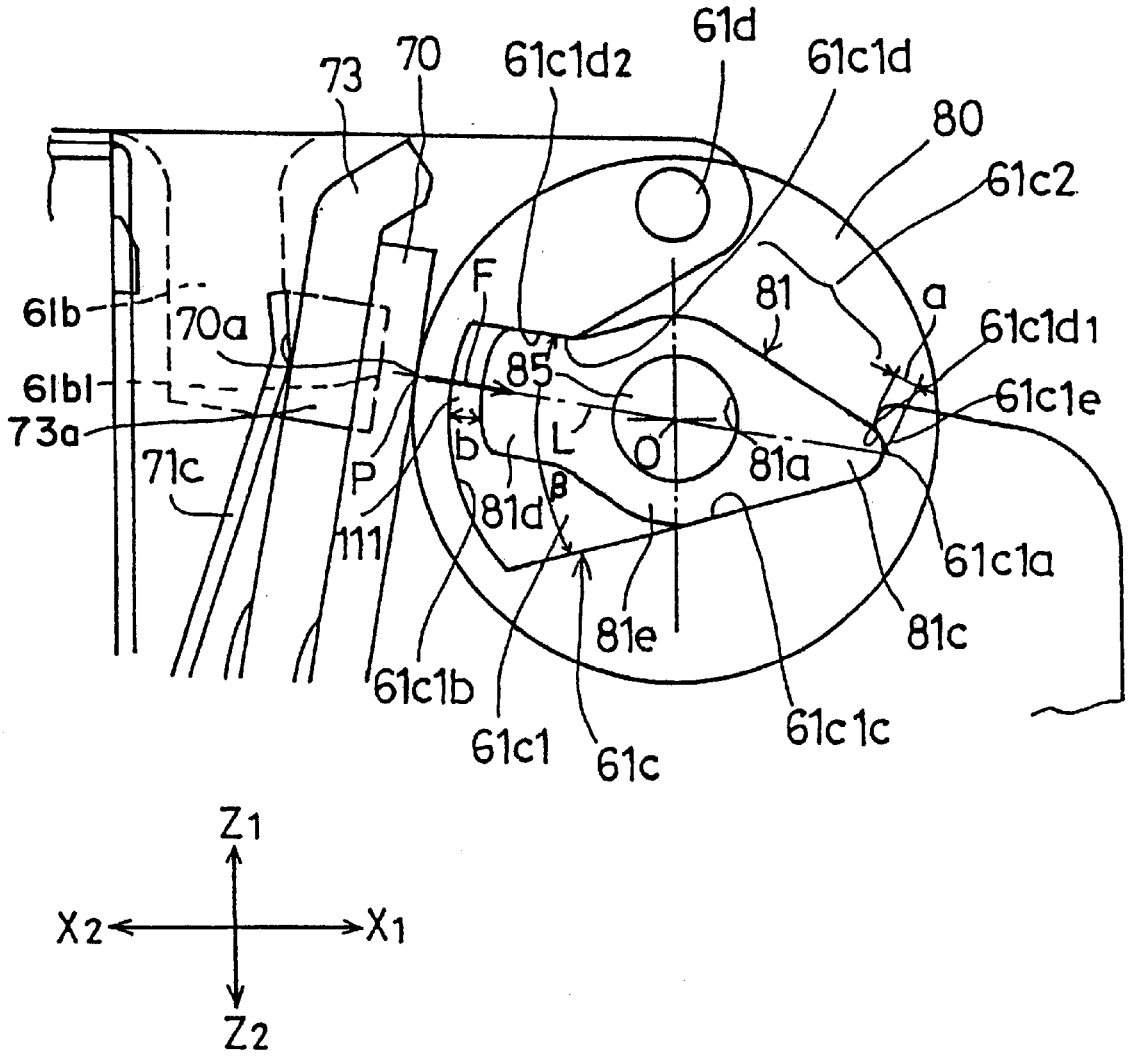
FIG. 7 is an enlarged view of a bearing and a bearing portion shown in FIG. 3.

As shown in FIG. 7, the bearing portions 61*c* and 62*c* are formed by a fan-like opening 61*c*1 having an opening angle β of approximately 40 degrees, and an opening 61*c*2 which is a part of the opening 61*c*1 facing outward. The peak 61*c*1*a* of the fan-like opening 61*c*1 is situated in the X1 direction, and the arcuate side 61*c*1*b* is situated in the X2 direction in parallel with the X1–X2 line. The lower side is indicated by 61*c*1*c*, and the upper side is indicated by 61*c*1*d*. The opening 61*c*2 is partially cut at the portion in contact with the upper side 61*c*1*d*, and extends in the direction between X1 and Z1. The upper side 61*c*1*d* is formed by an extremely short side 61*c*1*d*1 near the peak 61*c*1*a* and a short side 61*c*1*d*2 extending from the end of the arcuate side 61*c*1*b* in the Z1 direction. In the vicinity of the peak 61*c*1*a*, a V-shaped receiving portion 61*c*1*e* that widens in the X2 direction is formed by the lower side 61*c*1*c* and the short upper side 61*c*1*d*1.

The receiving portion 61*c*1*e* is situated on the extension line of a line L which connects the point P in contact with the thermal head 70 and the platen 80 to the center O of the platen 80 (i.e., the center of the bearing portions 61*c* and 62*c*), with the thermal head 70 and the platen 80 being incorporated.

The pin 61*d* is situated on a vertical line going through the center O of the bearing portion 61*c* in the Z1 direction.

The pulse motor 72 is accommodated in the pulse motor accommodating portion 66 and attached to the inner surface of the side plate 62. In the pulse motor accommodating portion 66, the pulse motor 72 can also be attached to the inner surface of the side plate 61.

The ceramic thermal head 70 is fixed onto the front surface of a radiating plate 73. The end of a flexible cable 75 is connected to the thermal head 70. The radiating plate 73 is provided with positioning lugs 73*a* and 73*b* on both sides, respectively.

The head pressing plate spring 71 comprises a main body 71*a*, a hook 71*b* formed by bending the upper end of the main body 71*a* in a reverse U-shape, and plate spring portions 71*c* and 71*d* formed by cutting out the main body 71*a* and arranged in line.

The thermal head 70 and the head pressing plate spring 71 are incorporated from above into the thermal head accommodating portion 67. The thermal head 70 is incorporated into the thermal head accommodating portion 67. Here, the lower edge 73*c* of the radiating plate 73 is supported by the thermal head receiving portion 65*a*, and the positioning lugs 73*a* and 73*b* are engaged with the L-shaped grooves 61*b* and 62*b*. In the head pressing plate spring 71, the hook 71*b* is engaged with the beam 64, and the main body 71*a* is attached along the side surface of the beam 64 in the X1 direction. Here, the plate spring portions 71*a* and 71*b* strongly press the radiating plate 73 with a force F in the X1 direction. The positioning lugs 73*a* and 73*b* are in contact with end grooves 61*b*1 (shown in FIG. 7) and 62*b*1 (shown in FIG. 3) so as to position the thermal head 70 (shown in FIG. 8C).

The flexible cable 75 is pulled out from the main body 60 in the X2 direction.

2) Platen module 42

As shown in FIGS. 3 and 4, the platen module 42 comprises the platen 80, bearings 81 and 82 on both sides, a sheet guide member 83, and a platen gear 84.

The platen 80 is provided with a shaft 85 that penetrates it. The bearings 81 and 82 are situated on both sides of the platen 80, and their center holes 81*a* and 82*a* are rotatably engaged with the shaft 85. The bearings 81 and 82 are provided with circular plates 81*b* and 82*b* on their rear surfaces, respectively. The bearings 81 and 82 each has vessel-like form corresponding to the shape of the bearing portions 61*a* and 62*c*. Each of the bearings 81 and 82 comprises a V-shaped top end portion 81*c*, a U-shaped bottom end portion 81*d*, and a wide center portion 81*e* (See FIG. 7). Each of the center holes 81*a* and 82*a* is formed in the center portion 81*e*. The thickness t1 of each of the bearings 81 and 82 is equal to the sum of the thickness t2 of each of the side plates 61 and 62 and the thickness t3 of a flange 83*b* of the sheet guide member 83.

The sheet guide member 83 is a synthetic resin molding, and comprises a sheet guide portion 83*a* extending in the Y1–Y2 directions, and flanges 83*b* and 83*c* on both ends of the sheet guide portion 83*a*. The flanges 83*b* and 83*c* have vessel-shaped openings 83*b*1 and 83*c*1 corresponding to the bearings 81 and 82. The flanges 83*b* and 83*c* are also provided on their peripheries with arcuate long holes 83*b*2 and 83*c*2 to be engaged with the pins 61*d* and 62*d*, protrusions 83*b*3 and 83*c*3 to be engaged with click-lock concave portions 61*e* or 61*f*, and a knob portion 83*b*4 to be handled when setting a recording sheet.

The platen 80 is disposed in the platen module accommodating portion 68 of the main body 60, with the bearings 81 and 82 engaged with the shaft 85 being also engaged with the bearing portions 61*c* and 62*c* via the opening 61*c*2 (See FIG. 7).

The sheet guide member 83 is attached so that the flanges 83*b* and 83*c* are situated on the outer surfaces of the side plates 61 and 62 of the main body 60, that the openings 83*b*1 and 83*c*1 are engaged with parts of the bearings 81 and 82 outwardly protruding from the side plates 61 and 62, that the long holes 83*b*2 and 83*c*2 are loosely engaged with the pin 61*d*, and that the protrusions 83*b*3 and 83*c*3 are engaged with the click-lock concave portions 61*e* or 61*f*. The sheet guide portion 83*a* is situated along the platen 80.

The platen gear 84 is fixed to the shaft 85.

The platen module 42 is arranged at the X1-direction end of the thermal head module 41.

3) Gear module 43

The gear module 43 comprises a box 92 integrally having shafts 90 and 91, and gears 93 and 94 rotatably supported by the shafts 90 and 91 and incorporated into the box 92.

The gear module 43 is attached to the outer surface of the side plate 62. The gear 93 meshes with the gear 72*a* of the pulse motor 72, and the gear 94 meshes with the platen gear 84.

4) Auto-cutter module 44

The auto-cutter module 44 cuts a sheet transported after printing to produce receipts, and comprises a fixed blade, a mobile blade, and a mechanism for moving the mobile blade (not shown). The auto-cutter module 44 is mounted onto the upper side of the main body 60, with pins 100 and 101 being engaged with the hole 61*g* of the side plate 61 and the groove 62*g* of the side plate 62.

The following is a description of the operations of the thermal printer 40 during a waiting operation and a printing operation.

FIG. 3 illustrates the thermal printer 40 during the printing operation. The platen module 42 is rotated clockwise, and the knob portion 83*b*4 faces diagonally downward. The protrusion 83*b*3 is engaged with the click-lock concave portion 61*e* and the protrusion 83*c*3 is engaged with a click-lock portion (not shown), similar to the click-lock portion 61*e*, on an outer surface of the side plate 62, thereby clock-locking the platen module 42.

The heat generating member 70*a* of the thermal head 70 is pressed to the platen 80 by the head pressing plate spring 71 with the force F, thereby putting the platen 80 in a closed state. Here, a recording sheet 49 is sandwiched between the thermal head 70 and the platen 80. Printing is carried out on the recording sheet 49 at point P, which is the printing point. The platen 80 is rotated clockwise by the pulse motor 72 via the gear module 43 and the platen gear 84, so that the recording sheet 49 is pulled out from the roll 48 in the direction of A, and, after the printing, transported in the direction of B. The recording sheet 49 printed and transported in the direction of B is then cut by the auto-cutter module 44 to produce a receipt.

An inlet passage 110 (shown in FIG. 8A) is passage for guiding the recording sheet 49 (shown in FIG. 8C) to the printing point P. The passage 110 is formed between the sheet guide portion 83*a* and the beam 65.

As shown in FIG. 7, the receiving portion 61*c*1*e* of the bearing portion 61*c* is situated on the extended line of the line L connecting the printing point P and the center O of the platen 80. Even if the platen 80 is subjected to the force F, the rotating force with respect to the receiving portion 61*c*1*e* of the platen 80 (i.e., the force of the bearing 81 slipping out through the opening 61*c*2 of the bearing portion 61*c*) is zero. The receiving portion 61*c*1*e* is V-shaped, and covers the V-shaped top end portion 81*c* of the receiving member 81, so as to prevent the top end portion 81*c* from moving in the Z1–Z2 directions. The bottom end portion 81*d* is in contact with the side 61*c*1*d*2 of the bearing portion 61*c*, so that the clockwise rotation of the bearing 81 around the receiving portion 61*c*1*e* is limited. Thus, the bearing 81 is firmly fixed in the bearing portion 61*c*, as in the case where the bearing is a circular plate, and the bearing portion is a circular hole. In this manner, the platen 80 is rotated without causing runout, and stable printing is carried out.

Since the bottom end portion 81*d* of the bearing 81 is in contact with the side 61*c*1*d*2 of the bearing portion 61*c*, and the top end portion 81*c* is in contact with the side 61*c*1*c* of the bearing 61*c*, clockwise rotation of the bearing 81 around the center point O is limited. Since the V-shaped top end portion 81*c* of the bearing 81 is in contact with the side 61*c*1*d*1 of the V-shaped receiving portion 61*c*1*e* of the bearing portion 61*c*, counterclockwise rotation of the bearing 81 around the center point O is limited.

The L-direction length a of the side 61*c*1*d*1 of the V-shaped receiving portion 61*c*1*e* is a little shorter than the width b of an allowance 111 between the bottom end portion 81*d* of the bearing 81 and the long arcuate side 61*c*1*b*.

The arcuate long holes 83*b*2 and 83*c*2 are movable in the clockwise direction, and they are allowed an opening angle $\alpha 1$ from the pin 61*d* in the X1 direction with respect to the center point O (shown in FIG. 7). The engagement of the arcurate long hole 83*b*2 with the pin 61*d* is shown in FIG. 3. The arcurate long hole 83*c*2 engages the pin 62*d* in a similar manner.

Figure 8A:
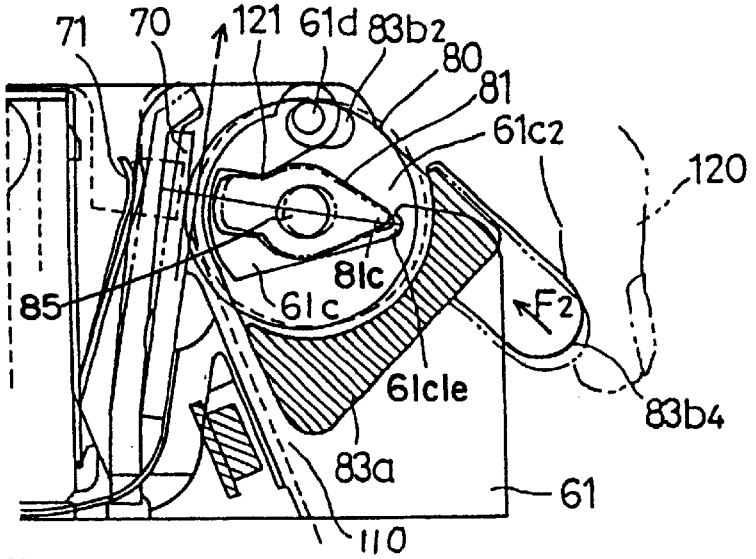
FIGS. 8A to 8C illustrate sheet setting operations.
Figure 8A:
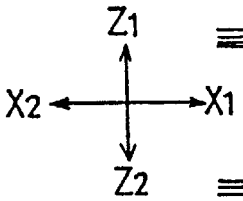
Figure 8B:
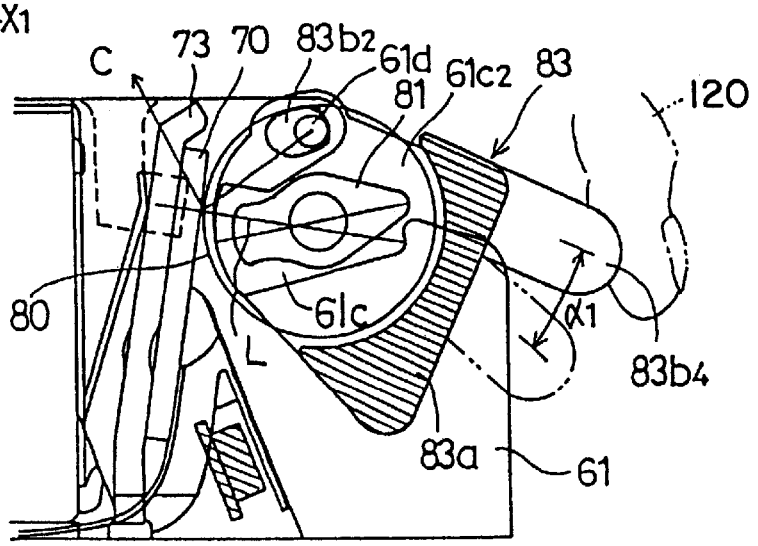
Figure 8C:
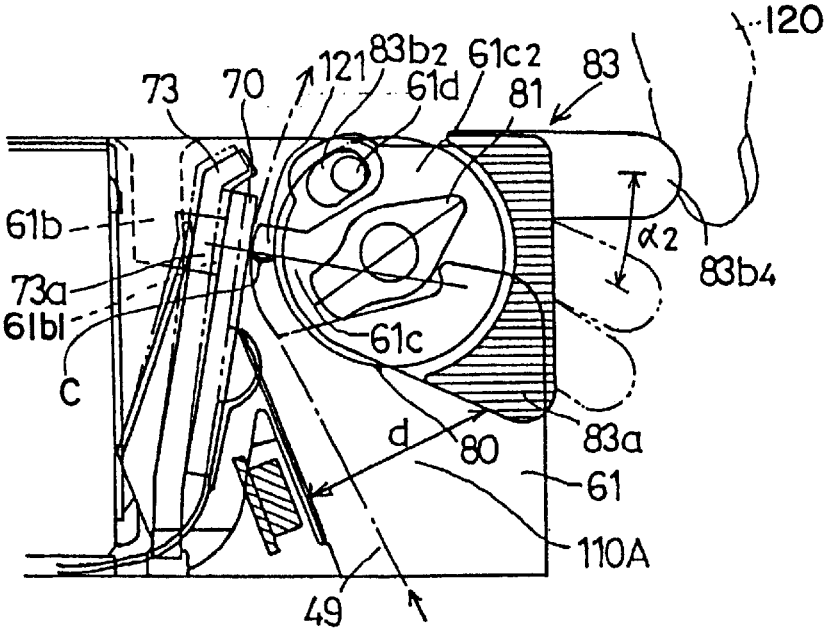

The following is a description of the procedures of setting a recording sheet by opening the platen 80, with reference to FIGS. 8A to 8C.

To set a recording sheet, the operator lifts up the knob portion 83*b*4 with a fingertip in the Z1 direction. This operation is followed by a first step and a second step.

In the first step, the bearing 81 is made detachable from the bearing portion 61*c*. In the second step, a half of the bearing 81 is pulled out from the bearing portion 61*c*. FIGS. 8A and 8B show the first step, and FIG. 8C shows the second step.

Since the knob portion 83*b*4 faces diagonally downward, if it is lifted up in the Z1 direction, a force F2 acts on the platen module 42 in a direction between the Z1 direction and the X2 direction. As a result, the platen 80 slightly pushes back the thermal head 70 in the X2 direction against the force of the head pressing plate spring 71, and the bearing 81 moves along the line L in the X2 direction. The V-shaped top end portion 81*c* of the bearing 81 then comes out from the V-shaped receiving portion 61*c*1*e* of the bearing portion 61*c*. Because of this, the bearing 81 becomes liberated and rotatable counterclockwise around the shaft 85. As the bearing 81 moves along the line L in the X2 direction, the wide center portion 81*e* is guided through a space 121 between the bearing portion 61*c* and the opening 61*c*2, so that the bearing 81 is slightly rotated counterclockwise. The V-shaped top end portion 81*c* then comes out from the V-shaped receiving portion 6*c*1*e* of the bearing portion 61*c*, and slightly moves toward the opening 61*c*2.

Since the arcuate long holes 83*b*2 and 83*c*2 have an allowance on the X1-direction side of the pins 61*d* and 62*d*, the platen module 42 is rotated counterclockwise around the shaft 85 by the angle $\alpha 1$, as shown in FIG. 8B. Here, the V-shaped top end portion 81*c* of the bearing 81 faces toward the opening 61*c*2.

The clockwise ends of the arcuate long holes 83*b*2 and 83*c*2 are brought into contact with the pins 61*d* and 62*d*. The platen module 42 is then rotated counterclockwise around the pin 61*d*. After being moved by an angle of α2, almost a half of the bearing 81 comes out from the bearing portion 61*c*. Also after being moved by the angle of α2, the protrusion 83*b*3 is engaged with the concave portion 61*f* and the protrusion 83*c*3 is engaged with a click-lock portion (not shown), similar to the click-lock portion 61*f*, on an outer surface of the side plate 62, thereby click-locking the platen module 42 as shown in FIG. 8C. When the fingertip 120 releases the knob 83*b*4, the platen module 42 remains as shown in FIG. 8C. Thus, the recording sheet 49 can be fed with both hands.

As the platen module 42 is rotated counterclockwise around the pin 61*d*, the platen 80 separates from the thermal head 70, putting itself in an open state. Here, the space 121 having the width c is formed between the platen 80 and the thermal head 70.

If the thermal head 70 is moved to form the space 121, the moving distance is limited to a very small length by the head pressing plate spring 71 and others. On the other hand, the move of the platen 80 is not restricted by the head pressing plate spring 71 and others, so that the platen 80 is allowed a long movable distance. The width c of the space 121 is great, and feeding the recording sheet 49 into the space 121 from below is easy.

When the platen module 42 is rotated by (α1+α2) as described above, the sheet guide portion 83*a* separates from the beam 65, and the inlet passage 110 turns into an inlet passage 110A having a greater width d as shown in FIG. 8C. Thus, feeding the recording sheet 40 into the space 121 from below becomes even easier.

The rotating direction of the bearing 81 and the platen module 42 in opening the platen is opposite to the rotating direction of the platen during the printing operation.

After feeding the recording sheet 49 into the space 121, the operator pushes down the knob 83*b*4 with the fingertip 120 in the Z2 direction to its original position shown in FIG. 8A. The platen module 42 first rotates clockwise around the pin 61*d* to return to the position shown in FIG. 8B, and then rotates clockwise around the shaft 85. The protrusions 83*b*3 and 83*c*3 are engaged with the concave portion 61*e*, thereby click-locking the platen module 42 as shown in FIG. 8A. The platen 80 presses the thermal head 70 with the recording sheet 49 in between. Thus, the setting of the recording sheet 49 is completed.

The platen 80 is brought into contact with the thermal head 70 when it rotates clockwise around the pin 61*d*. The contact portion of the platen 80 is moved on the circumference of a circle centered with respect to the pin 61*d*, and then brought into contact with the thermal head 70. Just before the contact with the thermal head 70, the contact potion of the platen 80 is moved in a direction of arrow C shown in FIG. 8B. Here, the component in the direction perpendicular to the surface of the thermal head 70 (i.e., the direction of the line L) is large. Also, since the thermal head 70 does not move at all, an excellent positional precision is maintained. Thus, the contact position between the platen 80 and the thermal head 70 does not deviate, and no printing unevenness occurs even after the recording sheet setting is repeated many times.

When the platen module 42 is click-locked, the operator can feel the click, and correctly realizes that the setting of the recording sheet is now complete. In this manner, the operator can be sure as to whether the sheet setting is complete or not, and incomplete sheet setting can be prevented.

To prevent deformation of the rubber-made platen 80, the thermal head 70 and the platen 80 are kept separate from each other at the time of shipment of the thermal printer 40. Since the platen 80 is moved in such a situation, the force of the head pressing plate spring 71 does not increase. Even if such a condition is maintained for a long period of time, the main body 60 will not be distorted.

In the following, a modification of the bearing structure of the thermal printer of FIG. 3 will now be described.

Figure 9A:
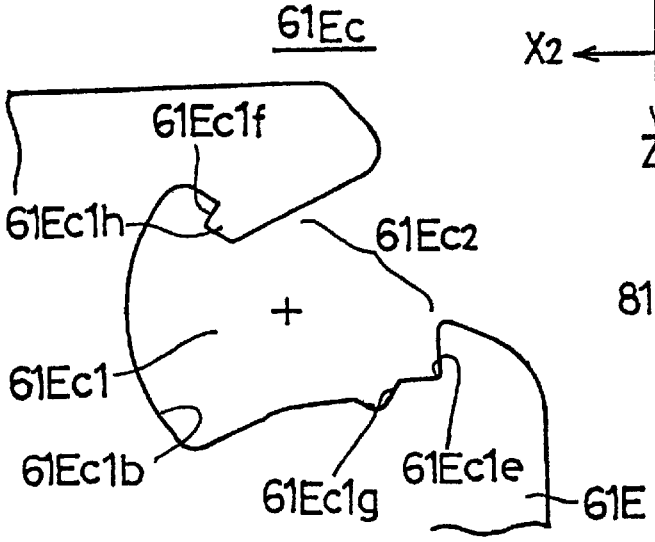
FIGS. 9A to 9C illustrate a modification of the bearing structure of the thermal printer of FIG. 3.
Figure 9B:
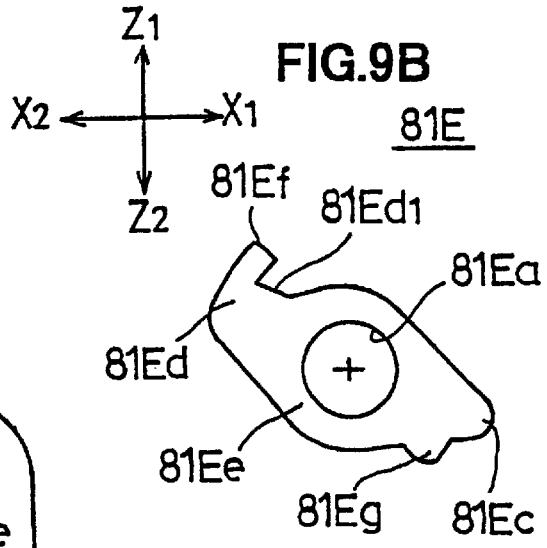
Figure 9C:
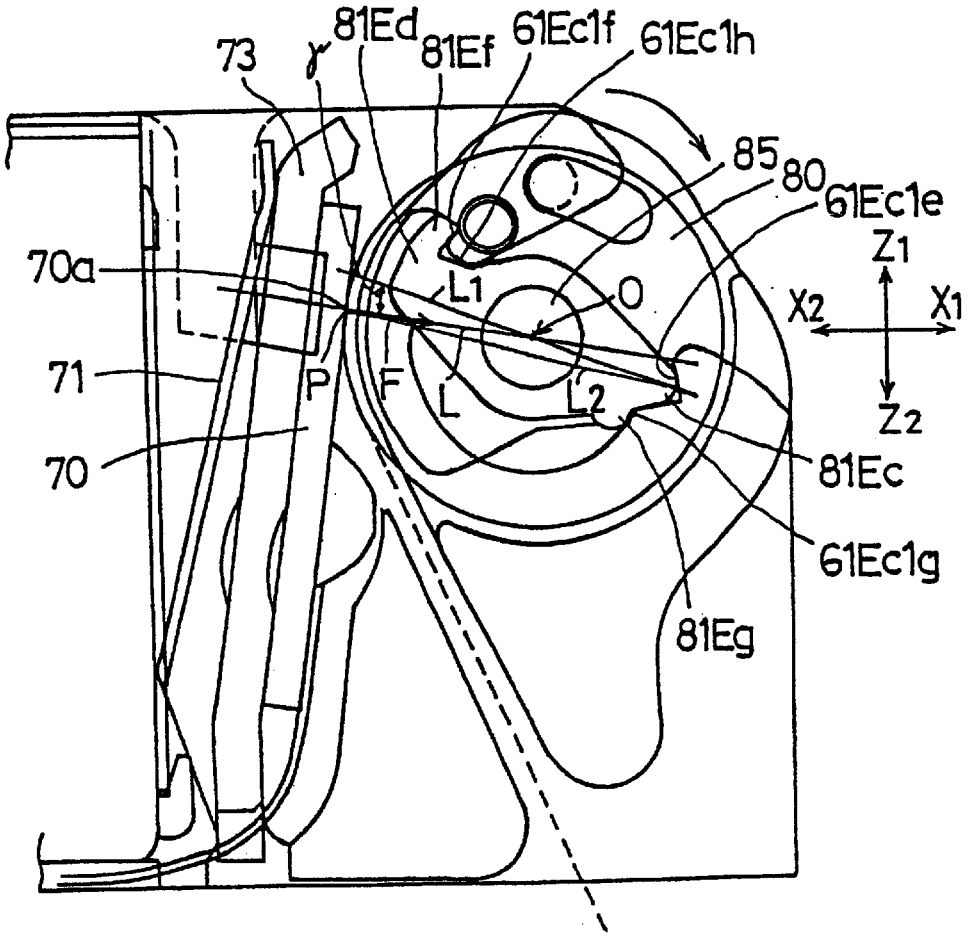

FIG. 9C illustrates the modification of the bearing structure of the thermal printer of FIG. 3. A bearing structure 300 includes a bearing portion 6E*c* shown in FIG. 9A and a bearing 81E shown in FIG. 9B. The bearing 81E is placed in the bearing portion 61Ec.

The bearing 81E is the same as the bearing 81 shown in FIG. 7, except for two protrusions 81Ef and 81Eg. The protrusion 81Ef protrudes like a hook from the bottom end portion 81Ed roughly in the Z1 direction. The protrusion 81Eg protrudes roughly in the Z2 direction in the vicinity of the V-shaped top end portion 81Ec and the center hole 81Ea.

The bearing portion 61Ec is the same as the bearing portion 61*c* shown in FIG. 7, except for two receiving portions 61Ec1*f* and 61Ec1*g*. The bearing portion 61Ec is formed in a modified side plate 61E having an opening 61Ec2 which communicates with a fan like opening 61Ec1 having an arcuate side 61*c*1 *b*. The receiving portion 61Ec1*f* receives the protrusion 81Ef, and the receiving portion 61Ec1*g* receives the protrusion 81Eg.

As shown in FIG. 9C, the bearing 81E is engaged in the bearing portion 61Ec. Here, the protrusion 81Ef is engaged with the protrusion 61Ec1*f*, the protrusion 81Eg is engaged with the protrusion 61Ec1*g*, and the top end portion 81Ec is engaged with the receiving portion 61Ec1*e*.

The force F of the head pressing plate spring 71 acting on the thermal head 70 pushing the plate 80 (i.e., the head pressure) is constantly received by the receiving portion 61Ec1*f* situated on the Z1 side with respect to the line L, and the receiving portion 61Ec1*g* situated on the Z2 side with respect to the line L. The receiving portion 61Ec1*e* restricts rotation of the bearing 81E around the shaft 85.

Since the head pressure is received by the two receiving portions 61Ec1*f* and 61Ec1*g*, wear can be minimized even if the process of setting a recording sheet is repeated many times. Accordingly, the center point of the platen 80 does not deviate, and the thermal printer can maintain high precision and avoid uneven printing for many years.

The line L1 passing through the top end portion 81Ec of the bearing 81E and the center O of the shaft 85 deviates from the line L by an angle γ (about 10 degrees) in the rotating direction of the platen 80. The center O of the shaft 85 deviates from the line L2 connecting the point P and the top end portion 81Ec of the bearing 81E in the Z1 direction. Because of the deviations, the bearing 81E is always subjected to the clockwise rotation force around the top end portion 81Ec by the head pressure F, even if there are size variations of the bearing portion 61Ec and the bearing 81E. A surface 81Ed1 on the Z1 side of the bottom end portion 81Ed of the bearing 81E is in contact with a protrusion 61Ec1*h* of the receiving portion 61Ec1*f* to receive the clockwise rotation force. Thus, the bearing 81E is firmly placed in the bearing portion 61Ec.

Figure 10:
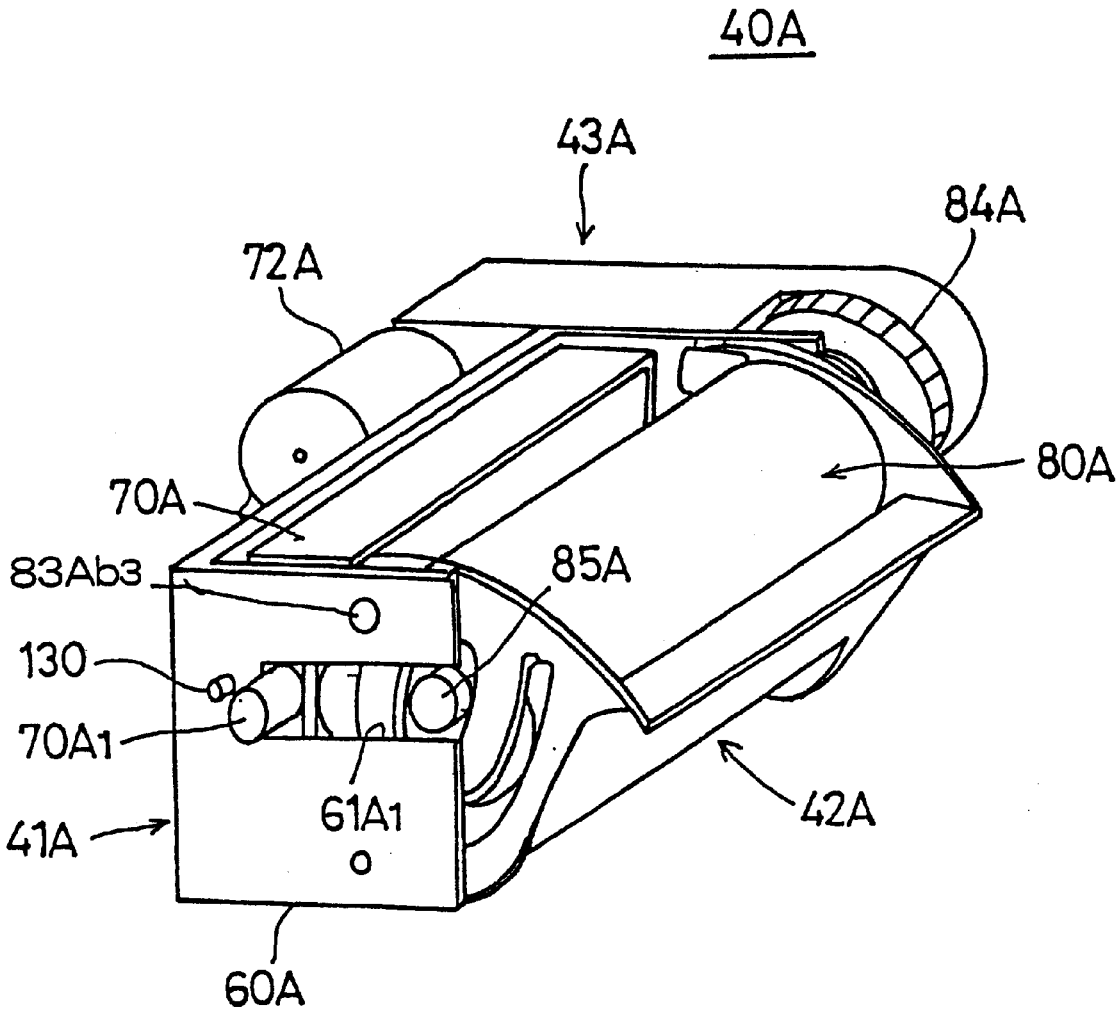
FIG. 10 is a perspective view of a second embodiment of the thermal printer of the present invention.
Figure 11:
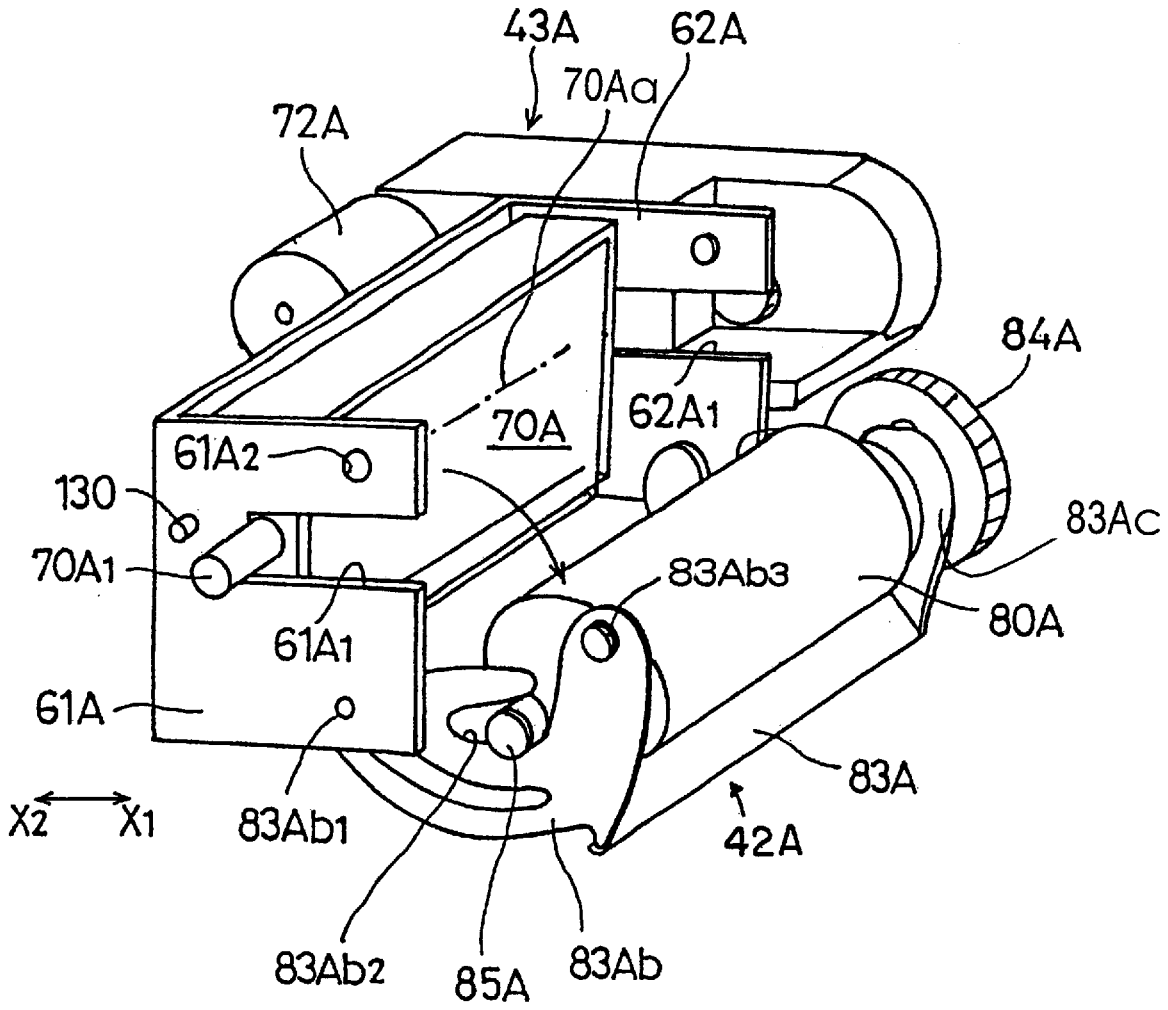
FIG. 11 illustrates the thermal printer of FIG. 10 when a recording sheet is set.

FIGS. 10 and 11 illustrate a thermal printer 40A of the second embodiment of the present invention. In FIGS. 10 and 11, components corresponding to those of FIGS. 3 and 4 are indicated by reference numerals with a suffix "A". The thermal printer 40A includes a thermal head module 41A, a platen module 42A, a gear module 43A, a motor 72A and an auto-cutter module (not shown). The platen module 42A, the gear module 43A, and the auto-cutter module are all connected to the thermal head module 41A. The mechanism for moving the platen module 42A when setting a recording sheet is the same as in the thermal printer 40 shown in FIGS. 3 and 4, except to the moving path of the platen module 42A.

The platen module 42A has a sheet guide member 83A supporting a platen 80A. The sheet guide member 83A is provided with flanges 83Ab and 83Ac rotatably attached to a main body 60A with a support pin 83Ab1. A shaft 85A of the platen 80A is engaged with a long hole 83Ab2 of the flange 83Ab. Grooves 61A1 and 62A1 extending in the X1 and X2 directions are formed on the side plates 61A and 62A of the main body 60A. A positioning pin 70A1 is deeply engaged with the grooves 61A1 and 62A1 so as to position the thermal head 70A. The grooves 61A1 and 62A1 extend through the center of the heat generating member 7OAa of the thermal head 70A, and are perpendicular to the surface of the thermal head 70A. Reference numeral 130 indicates a head pressing shaft.

During the waiting period, the platen module 42A is rotated counterclockwise around the support pin 83Ab1, and a lock pin 83Ab3 is engaged with a lock hole 61A2 of the side plates 61A and 62A. The platen 80A presses the heat generating member 70A of the thermal head 70A, thereby putting the thermal printer 40A in a platen close state. The shaft 85A is engaged with the grooves 61A1 and 62A1.

Figure 12:
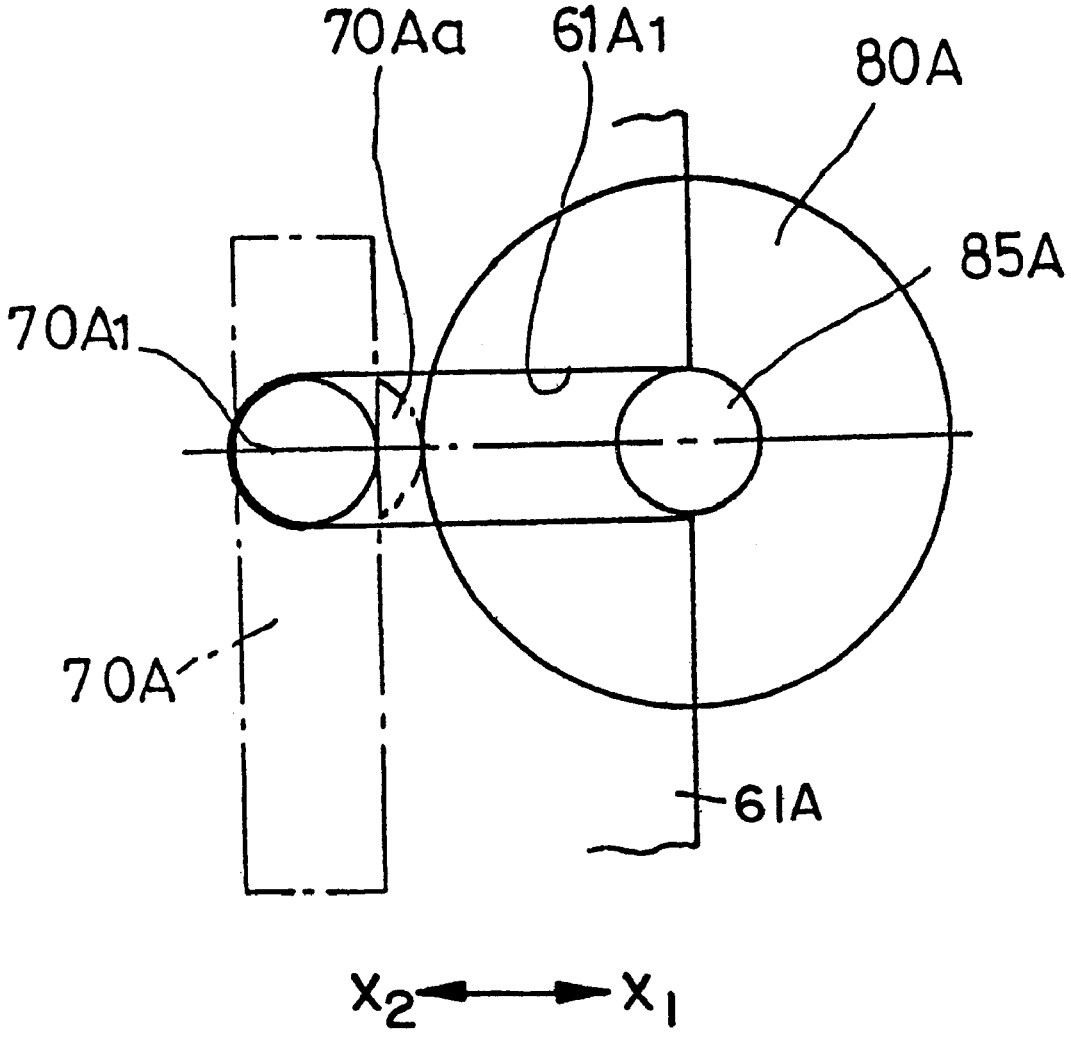
FIG. 12 illustrates the movement of the platen with respect to the thermal head.

As shown in FIG. 11, the platen module 42A is unlocked and rotated clockwise around the support pin 83Ab1. The platen 80A is separated from the thermal head 70A, and a recording sheet is inserted between the thermal head 70A and the platen 80A. The platen module 42A is then rotated counterclockwise around the support pin 83Ab1, and returned to its original image, thereby completing sheet setting. At this point, the platen 80A presses the thermal head 70A, with the recording sheet being sandwiched by the platen 80A and the thermal head 70A as shown in FIG. 12.

The shaft 85A is engaged with and guided by the grooves 61A1 and 62A1, so that the platen 80A vertically approaches the surface of the thermal head 70A. Even if the lock position of the platen module 42A fluctuates with respect to the main body 60A, the pressure contact position between the platen 80A and the thermal head 70A does not change. Also, the thermal head 70A is positioned by the positioning pin 70A1 and the grooves 61A1 and 62A1. This adds to the stability of the pressure contact position between the platen 80A and the thermal head 70A. Thus, the pressure contact position on-the thermal head 70A can be determined with precision.

The grooves 61A1 and 62A1 also determine the positions of the thermal head 70A and the platen 80A. Thus, the pressure contact position on the thermal head 70A can be determined with higher precision. In this manner, printing unevenness can be prevented even after the sheet setting is repeated.

Figure 13:
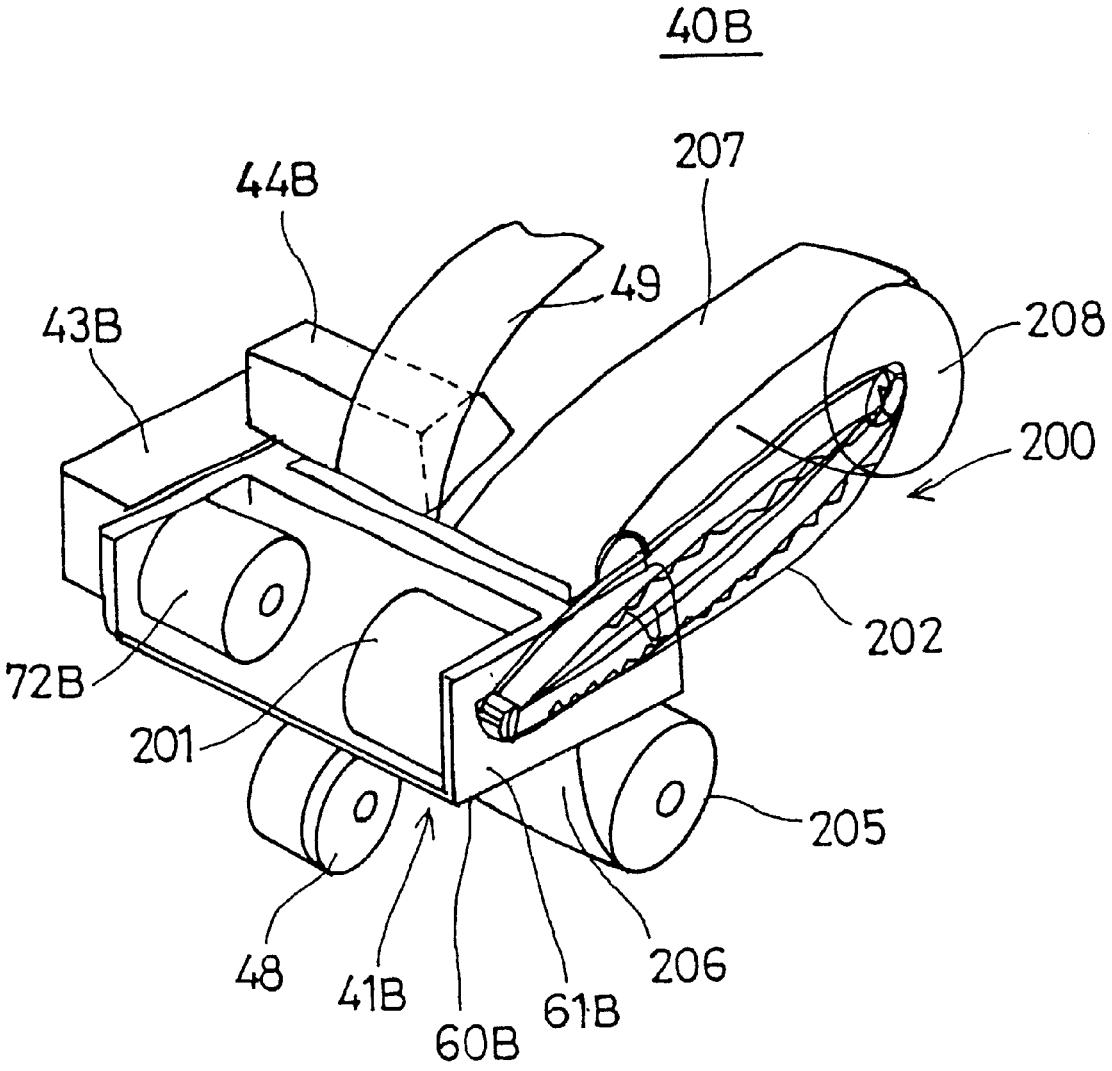
FIG. 13 is a perspective view of a third embodiment of the thermal printer of the present invention.
Figure 14:
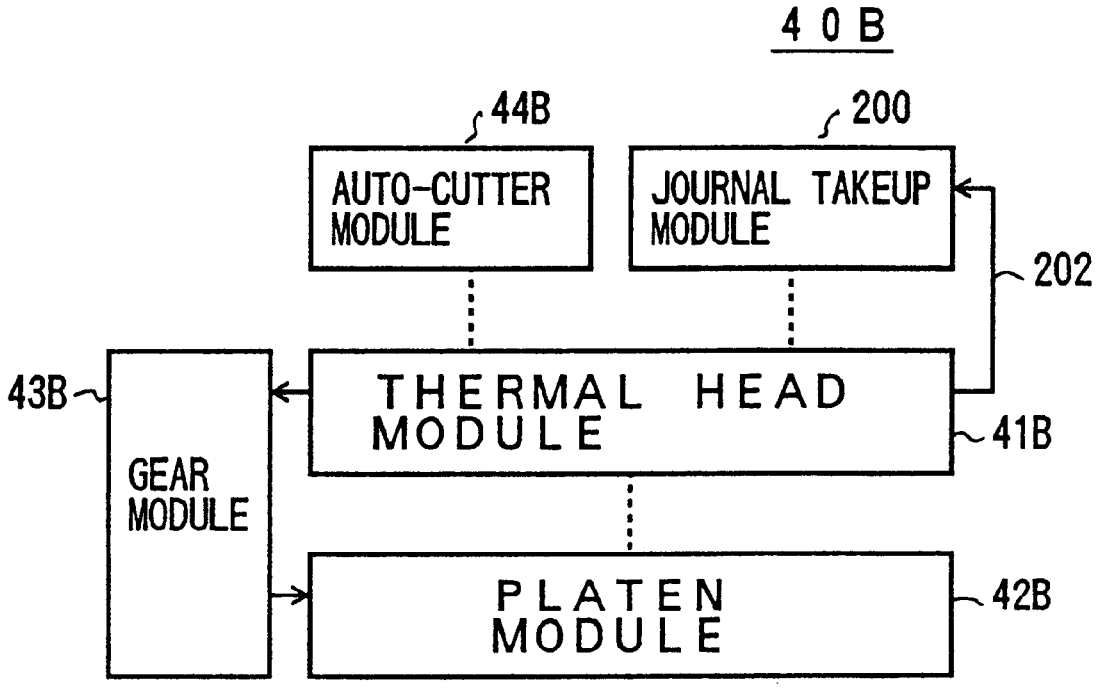
FIG. 14 is a diagram of the structure of the thermal printer of FIG. 13.

FIG. 13 illustrates a thermal printer 40B of the third embodiment of the present invention. In FIG. 13, components corresponding to those shown in FIGS. 3 and 4 are indicated by reference numerals with a suffix "B". The thermal printer 40B has the same mechanism of moving the platen module when setting a recording sheet as in the thermal printer 40 of FIGS. 3 and 4. As shown in FIG. 14, a platen module 42B, a gear module 43B, an auto-cutter module 44B, and a journal takeup module 200 are all connected to a thermal head module 41B. The thermal printer 40B integrally comprises a receipt producing printer and a journal printer. A journal is a printed record of the contents in a corresponding receipt.

The journal takeup module 200 is disposed next to the auto-cutter module 44B upon a main body 60B, and driven via a belt 202 by a motor 201 attached to the main body 60B symmetrically with a pulse motor 72B.

A recording sheet 49 going through the auto-cutter module 44B turns into receipts. The same contents as in each receipt are printed on a corresponding journal sheet 206 pulled out from a roll 205. The printed journal sheet 207 is then taken up by the journal takeup module 200, thereby forming a journal roll 208.

Figure 15:
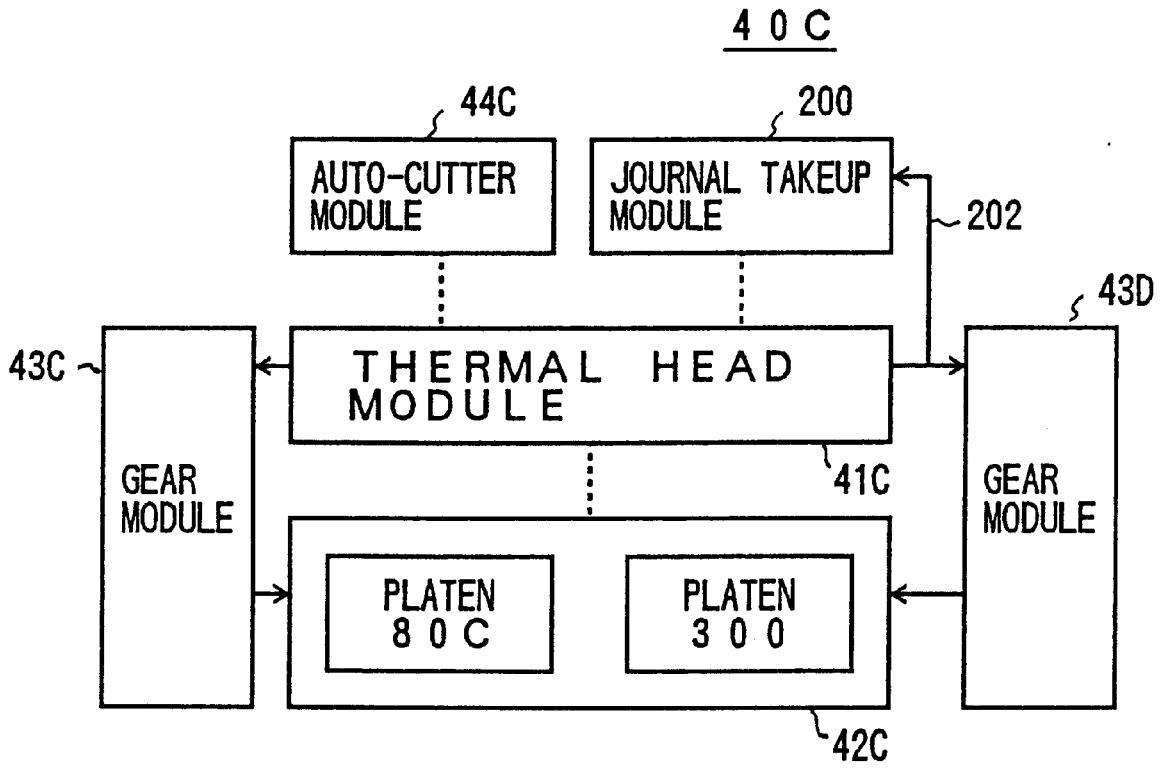
FIG. 15 is a diagram of the structure of a fourth embodiment of the thermal printer of the present invention.
Figure 16:
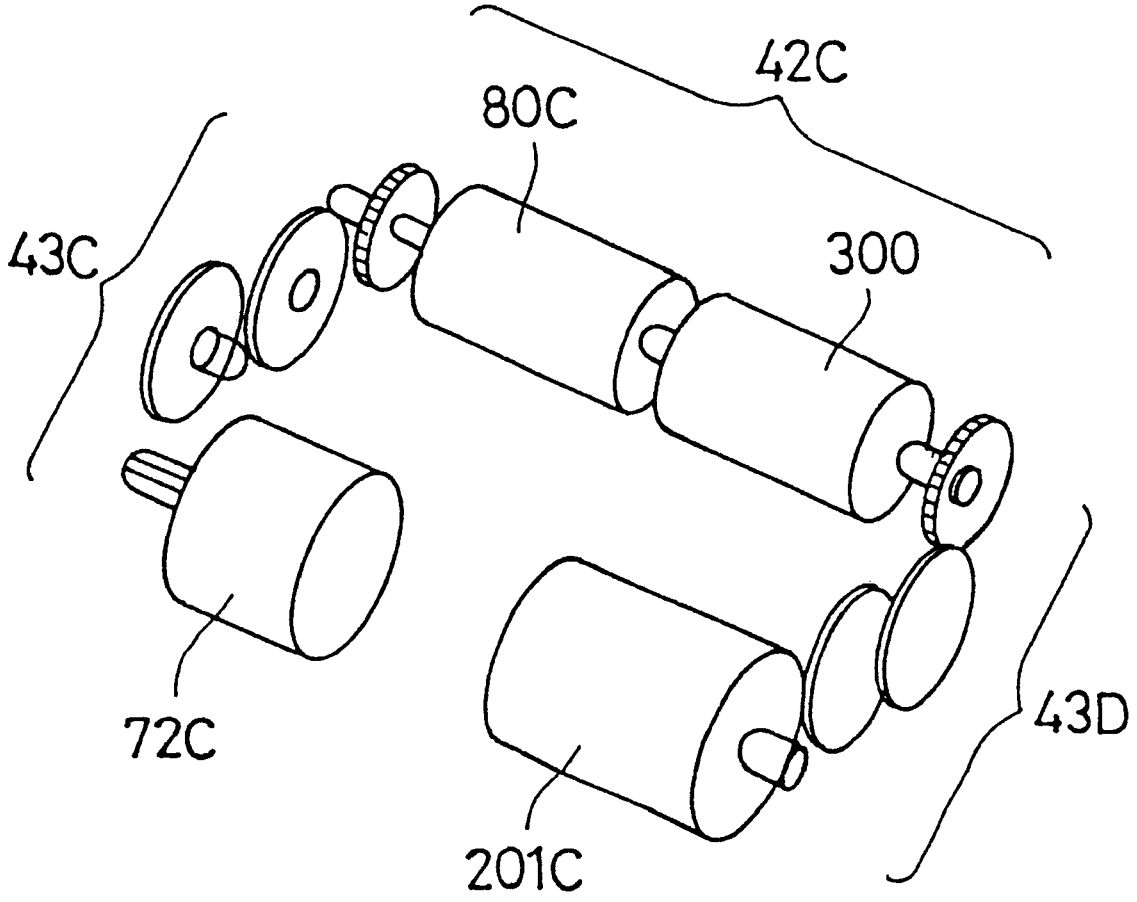
FIG. 16 illustrates the platen modules and the gear modules shown in FIG. 15.

FIG. 15 illustrates a thermal printer 40C of the fourth embodiment of the present invention. In FIG. 15, components corresponding to those shown in FIGS. 3 and 4 are indicated by reference numerals with a suffix "C". The thermal printer 40C integrally comprises a receipt producing printer and journal printer. As shown in FIG. 16, two platens 80C and 300 form a double-platen structure in place of the platen module 42B of the thermal printer 40B, and a gear module 43C and a gear module 43D are symmetrically disposed.

The platen 300 is rotated independently of the platen 80C. The journal sheet is to be closely printed, so no excessive amount of the journal sheet is not fed into the printer. When the platen module 42C is moved, the platen 80C and the platen 300 separate from the thermal head. At this point, the recording sheet 49 and the journal sheet are set.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

The present application is based on Japanese priority application No. 10-271081 filed on Sep. 25, 1998, the entire contents of which are hereby incorporated by reference.

What is claimed is:

1. A thermal printer comprising:

a body provided with a pin and having an slit formed in the body;

a thermal head attached to the body;

a shaft;

a platen attached to the shaft; and a member attached to the shaft and engaged with the body opening, the body opening having a first portion on which the member can slide and a second portion in which the member is locked, the member having a guide opening formed therein, wherein a movement of the platen is guided by the pin, the pin being engaged with the guide opening so as to move the platen in a direction substantially perpendicular to a surface of the thermal head.

2. The thermal printer as claimed in claim 1, further comprising a spring which is supported by the body and which applies a force to the thermal head so as to push the platen so that the member is pushed against the second portion of the body opening.

3. The thermal printer as claimed in claim 1, further comprising another member attached to the shaft and which rotates around the shaft to release the member from the second portion of the body opening.

4. The thermal printer as claimed in claim 3, wherein said another member acts as a sheet guide member.

5. The thermal printer as claimed in claim 1, further comprising:

a spring which is supported by the body and which applies a force to the thermal head to push the thermal head against the platen where the member is retained in the second portion of the body opening; and another member attached to the shaft and which rotates around the shaft to release the member from the second portion of the body opening so that the platen moves away from the thermal head due to the force of the spring.

6. The thermal printer as claimed in claim 1, wherein the body comprises a side wall in which said body opening is formed.

7. The thermal printer as claimed in claim 1, wherein said member comprises a bearing.

8. The thermal printer as claimed in claim 1, wherein said member has a first portion, and the second portion of the body opening has a shape corresponding to said first portion.

9. A thermal printer comprising:

a body having an opening formed therein;

a thermal head movably attached to the body;

a shaft;

a platen attached to the shaft; and a rotable member attached to the shaft and engaged with the opening, the opening having a first portion on which the rotable member slides to engage the platen against the thermal head and a second portion which captures the rotable member to maintain the engagement of the platen against the thermal head, the rotable member having a protrusion and the second portion of the opening having a recess which receives the protrusion to capture the rotable member.

10. The thermal printer as claimed in claim 9, further comprising:

another member attached to the shaft and which rotates around the shaft to disengage the protrusion from the recess to release the rotable member from the second portion of the opening;

a spring which is supported by the body and which applies a force to the thermal head to urge the thermal head against the platen where the rotable member is captured in the opening and to urge the platen away from the thermal head where the rotable member is released.

11. The thermal printer as claimed in claim 10, wherein said another member further acts as a sheet guide member.

12. The thermal printer as claimed in claim 10, wherein said rotable member comprises a bearing.

* * * * *